United States Patent [19]

Barnett

[11] 4,258,689

[45] Mar. 31, 1981

[54] CROSS BOWS

[76] Inventor: Bernard T. Barnett, 3, Goldthorn Crescent, Wolverhampton, England

[21] Appl. No.: 87,779

[22] Filed: Oct. 24, 1979

Related U.S. Application Data

[63] Continuation of Ser. No. 855,955, Nov. 29, 1977, abandoned.

[51] Int. Cl.[3] ..... F41B 5/00

[52] U.S. Cl. ..... 124/25; 124/35 R

[58] Field of Search ..... 124/25, 88, 90, 35 R

[56] References Cited

U.S. PATENT DOCUMENTS

| | | | |
|---|---|---|---|
| 3,028,851 | 4/1962 | Drake | 124/25 X |
| 3,269,380 | 8/1966 | Stevens | 124/25 |
| 3,670,711 | 6/1972 | Firestone | 124/25 |
| 3,783,852 | 1/1974 | Shepherd | 124/25 X |

*Primary Examiner*—William R. Browne

*Attorney, Agent, or Firm*—Owen, Wickersham & Erickson

[57] ABSTRACT

A cross bow stock comprises a butt which is pivotally connected with the fore end portion and also connected with cocking means so that the butt can be used as a lever to cock the bow. Hooks for engaging the string are guided for movement along a path which extends along the fore end portion of the stock. Over the major part of the path, the hooks project above an upper surface of the fore end portion but, towards the front of the stock, the path diverges downwardly from the upper surface of the fore end portion, so that the hooks are moved clear of the path of the string and bolt when the bolt is fired.

2 Claims, 3 Drawing Figures

CROSS BOWS

This is a continuation of Ser. No. 855,955, filed Nov. 29, 1977 now abandoned.

BACKGROUND OF THE INVENTION

This invention relates to a cross bow. A cross bow comprises a stock which includes a butt and a fore end portion, a resiliently flexible cross piece called a bow prod herein and in the art which is supported by the fore end portion of the stock, a string whereof opposite ends are attached to corresponding ends of the bow prod and a releasable catch for holding the string at a position spaced rearwardly from the bow prod when the bow is cocked.

When the string of a cross bow lies adjacent to the bow prod, in what is called herein the rest position of the string, there is little or no tension in the string and the prod is substantially unstressed. When the bow is in the cocked condition, and the bow prod is bent, there is a large tension in the string. Cross bows are commonly cocked by grasping the string with the hands and drawing the string along the fore end portion to the catch. Because of the large tension which has to be established in the string, this is a difficult operation and, in some cases, is impossible for users who lack considerable physical strength. Furthermore, as the surface area of the string over which the user can exert the necessary pressure is severly limited by the diameter of the string, some degree of pain can be inflicted on the user.

To enable cross bows to be cocked more easily, there have been provided for use with certain cross bows separate tools which have relatively movable parts engageable respectively with the stock and with the string. These tools can then be manipulated to move the string along the stock to the catch.

Such tools can include a handle having an adequate surface area over which a user can apply the force necessary to cock the bow without suffering discomfort and the tool can be arranged to provide a mechanical advantage so that the force which it is necessary for the user to apply to the tool can be less than the force which the tool applies to the string.

The use of a separate tool for cocking a cross bow is inherently inconvenient, as the tool must be carried in addition to the bow and bolts.

SUMMARY OF THE INVENTION

It is an object of the invention to provide in a cross bow means for cocking the bow which enables this operation to be performed more easily and conveniently than is possible with known bows.

According to the invention there is provided a cross bow comprising trigger means depending from the fore end portion and operatively associated with a catch for releasably holding the string at a cocked position, cocking means for engaging the string and drawing the string from a rest position to the cocked position and a hand grip which comprises two elongated parts, a first of which parts is rigid with the fore end portion, extends from a rear end thereof in a downward direction when the bow is in the normal position for use, has a rear face, and has a front face which faces towards the trigger means, and a second of which parts is a forward part of the butt and has a front face, wherein there is provided first pivot means for connecting the cocking means to an upper end of said second part and second pivot means adjacent to lower ends of said parts for connecting said parts together for relative movement about a pivot axis which is perpendicular to the respective lengths of said parts, whereby the butt can be used as a lever by pivoting the second part away from the first part to draw the string to the cocking position, wherein pivoting of the second part toward the first part is limited by engagement of said front face of the second part with said rear face of the first part and when said front face of the second part is engaged with said rear face of the first part the respective lengths of the first and second parts are parallel to each other.

Arrangement of the first and second pivot means at opposite ends of the second part of the hand grip with the length of the hand grip normally extending downwardly when the bow is in position for use enables the string to be moved from its rest position to its cocked position by a single pivoting movement of the butt and second part of the hand grip.

DETAILED DESCRIPTION

Figure 1:
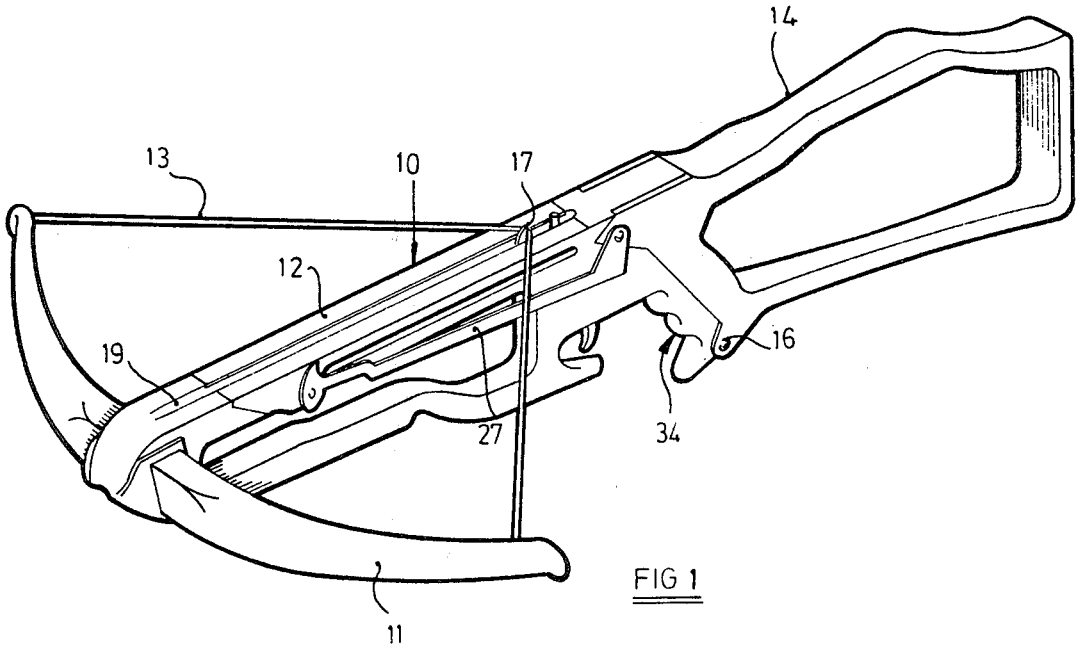
FIG. 1 shows a perspective view of a cross bow incorporating one example of a stock in accordance with the invention.

The cross bow shown in FIG. 1 comprises a stock 10, a resiliently flexible bow prod 11 which is supported by a fore end portion 12 of the stock and a string 13 whereof opposite ends are attached to corresponding ends of the bow prod. The stock further comprises a butt 14 which is connected with the fore end portion 12 for pivoting movement relative thereto about a transverse pivot axis 15 by a pivot pin 16.

In the cocked position of the bow, which is illustrated in FIG. 1, the bow prod 11 is bent and the string 13 is held at a position on the stock spaced rearwardly from the bow prod by a catch 17. The fore end portion 12 of the stock has a flat upper surface 18, the guide surface hereinbefore referred to, in which there is formed a guideway 19 along which a bolt can be projected by the string when the latter is released from the catch. Adjacent to the front of the fore end portion 12, there is a formation for receiving the bow prod 11, this formation being an aperture 20 of rectangular shape corresponding to the cross section of the bow prod 11.

The catch 17 is mounted in the fore end portion 12 at a position nearer to the rear end thereof than to the front end thereof. The catch is mainly disposed within a slot which extends downwardly from the upper surface 18 of the fore end portion and is connected to the fore end portion for pivoting movement relative thereto by a pivot pin 21 which is parallel to the pivot pin 16.

Figures 2, 3:
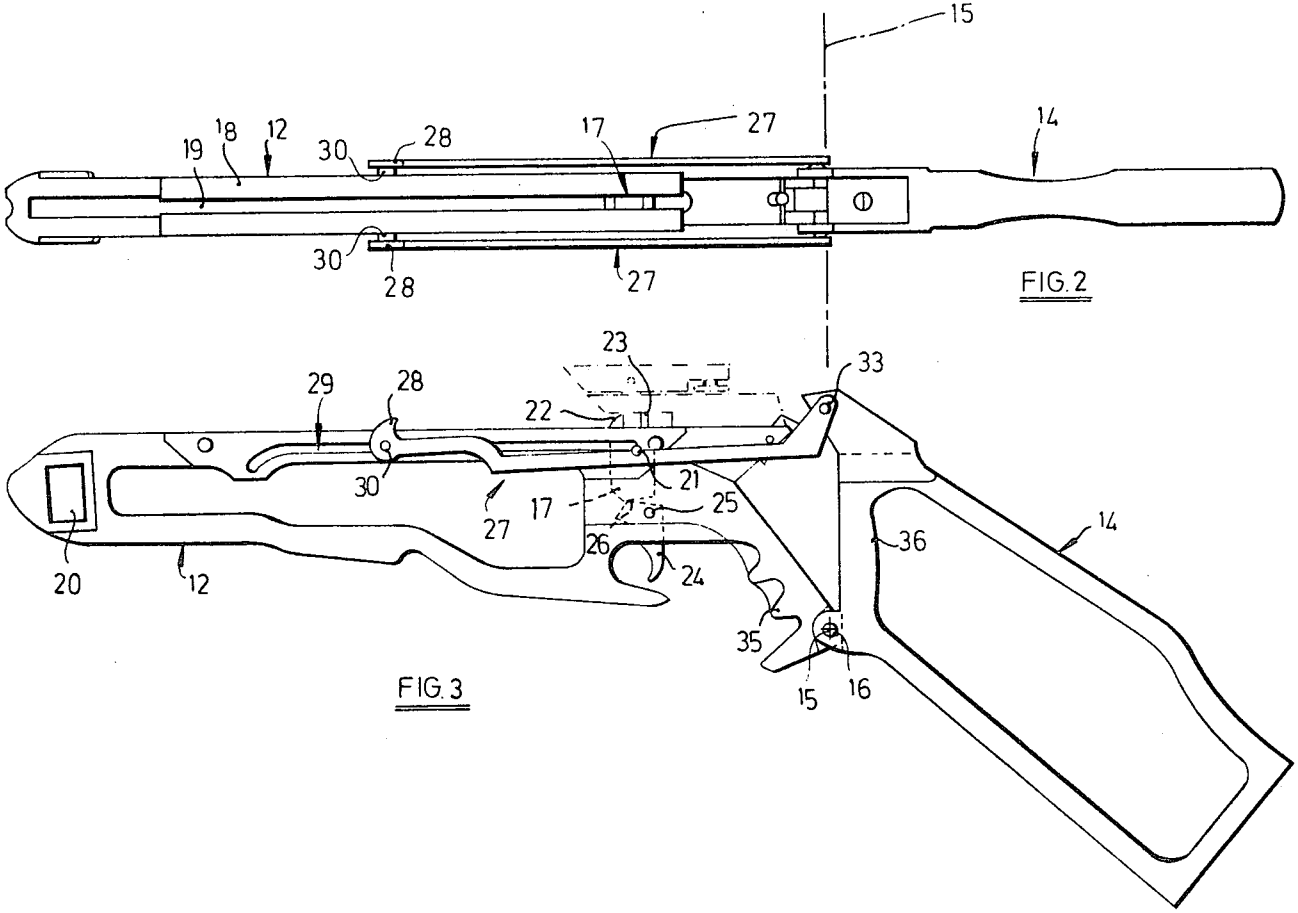
FIG. 2 shows a plan view of the stock and FIG. 3 shows a side elevation of the stock, a butt of the stock being shown in a position approximately half way along a permitted range of pivoting movement relative to a fore end portion of the stock.

When the bow is cocked, the catch occupies the position illustrated in FIG. 1 in which front and rear projections of the catch 22 and 23 respectively project upwardly from the upper surface 18 of the fore end portion. The catch is held in this cocked position by a trigger 24 also disposed mainly within the slot of the fore end portion and also pivotally connected to the fore end portion by a pivot pin 25 which is parallel to the pivot pin 16. A lower portion of the trigger 24 projects from a lower end of its slot so that it is accessible to a user. An upper portion of the trigger is engageable with a shoulder 26 on the catch to constrain the catch against pivoting movement about the pin 21 in a direction (a counter clockwise direction as shown in FIG. 3) which could move the shoulder 26 rearwardly. When the trigger is pivoted in the same counter clockwise direction by drawing the lower portion of the trigger rearwardly, the trigger is moved out of engagement with the shoulder 26 and the catch is thereby freed for pivoting movement relative to the fore end portion which carries the front projections 22 below the upper surface 18. Such pivoting of the catch is limited so that the rear projection 23 remains projecting above the surface 18.

The stock 10 includes a mechanism for drawing the string 13 from the rest position (not shown) in which it lies adjacent to the bow prod 11 to the cocked position. The mechanism includes a pair of cocking members which have the same elongate form and are arranged parallel to one another on opposite sides of the fore end portion 12. The cocking members are arranged with their lengths extending forwardly and rearwardly of the stock.

Adjacent to its forward end, each cocking member includes a formation namely a hook 28, which is engageable with the string 13 and is movable along the fore end portion of the stock to draw the string from the rest position to the cocked position.

Each hook 28 is guided for movement along a respective path by an adjacent cam track 29 formed in the fore end portion 12. A respective cam follower in the form of a pin 30 projects from each cocking member 27 at a position adjacent to its hook 28 into the associated cam track 29. Each cam track 29 includes a forward part 32 which is curved. The rear part 31 is parallel to the surface 18 and is so spaced downwardly therefrom that when the cam follower is in the rear part 31 of the cam track, the associated hook 28 projects above the surface 18 as shown in FIG. 3. The front part 32 of each cam track diverges from the surface 18 in the formed direction so that as each pin 30 moves forwardly along this part of the cam track, it moves its associated hook 28 downwardly until such hook is disposed completely below the surface 18 and therefore out of the path of the string when the latter moves from its cocked position to or even beyond its rest position.

The mechanism for drawing the string 13 from the rest position to the cocked position further includes the pivoted butt 14. The two cocking members 27 are pivotally connected to the butt 14 by a pivot pin 33 which is parallel to the pivot pin 16. The pivot pin 33 is situated adjacent to the rearward ends of the cocking members 27 and adjacent to the forward end of the butt 14.

When the butt is moved about the pivot axis 15 relative to the fore end portion 12, the pivot pin 33 moves through an arc, the chord of which is approximately parallel to the cam tracks 29 and is spaced rearwardly therefrom. Thus, by pivoting the butt about the axis 15, the cocking members 27 can be moved along their respective paths of movement, the limits of which are defined by ends of the cam track 29. The length of the arc through which the pivot pin 33 can be moved by pivoting the butt relative to the fore end portion is sufficiently long to enable the hooks 28 to be moved, by a single pivoting movement of the butt, from their rest positions below the surface 18 (shown in FIG. 1) to positions corresponding to the cocked position of the string engaged with the hooks.

The stock includes a hand grip 34 which is situated to the rear of the trigger 24 so that a user can grip the hand grip with one hand and employ one finger of that hand to operate the trigger. It will be seen from FIG. 3, that the hand grip comprises two relatively movable elements 35 and 36 respectively. The element 35 is a part of the fore end portion 12 of the stock and may be formed integrally with the remainder of the fore end portion. The element 36 is a part of the butt 14 and may be integral with the remainder of the butt. The pivot pin 16 extends through aligned apertures in the elements 35 and 36, so that the pivot axis 15 passes through these elements.

As can be seen from FIGS. 1 and 3, the elements 35 and 36 are both elongated. When the bow is in the normal position of use with the guide surface 18 horizontal and facing upwardly and the hooks 28 of the cocking members disposed below the guide surface, the respective lengths of the elements 35 and 36 are parallel to each other and extend downwardly, one from the remainder of the fore end portion and the other from the pivot pin 33 with a rear face of the element 34 in contact with a front face of the element 36 and with a front face of the element 34 facing toward the trigger 24. It will be seen that the elements 35 and 36 meet in a plane which extends approximately along the middle of the hand grip from a position adjacent to the pivot pin 16 in an upward and forwardly inclined direction towards a position adjacent to the catch 17. The distance between the pivot axis 15 and the axis of the pivot pin 33 is smaller, preferably a plurality of times smaller, than the distance between the pivot axis 15 and the rearmost end of the butt 14. The butt can be used as a lever to move the cocking members 27 along their respective cam tracks 29 and gives the user a mechanical advantage if the user applies a force to the butt at a position adjacent to the rearmost end thereof. The butt shown in FIG. 3 may be extended rearwardly by the attachment of an extension which is formed to fit against the shoulder of a user when the bow is fired. Such an extension increases the length of the lever and therefore the mechanical advantage which can be obtained.

When the bow is to be cocked, the butt 14 is in a raised position with the elements 35 and 36 of the hand grip in contact along the meeting plane and the cam followers 30 are at the front ends of their respective cam tracks 29 so that the hooks 28 are below the surface 18. When the string is in the rest position, the bow prod 11 is somewhat curved so that the string lies to the rear of the hooks 28. If the butt is then pivotted about the axis 15, the hooks 28 move rearwardly and rise above the surface 18 to engage the string and continued movement of the hooks draws the string rearwardly along the surface 18 towards the catch 17. Before the bow is cocked, the catch occupies a position in which the front projection 22 lies below the surface 18. Accordingly, the string can be drawn rearwardly past the projection 22 into engagement with the rear projection 23. Continued movement of the string in the rearward direction pushes the projection 23 rearwardly and so pivots the catch in a direction to raise the front projection 22 above the surface 18.

Such pivoting also brings the shoulder of the catch into engagement with the trigger so that the latter can prevent return pivoting of the catch. The butt can then be raised to return the cocking members 27 to their initial positions. It will be noted that although the tension in the string will tend to pivot the catch 17 about its pivot pin 21, this will apply to the trigger 24 through the shoulder 26 a force directed substantially along a radius of the pivot pin 25. Since the catch applies substantially no torque to the trigger, the latter will not pivot until the user pulls on the lower part of the trigger. The bow may further include a safety catch of known form to prevent inadvertent release of the string from the catch.

I claim:

1. A cross bow comprising:

a stock which includes a butt and a fore end portion having a guide surface for a bolt, a bow prod supported by the fore end portion, a string having opposite ends attached to corresponding ends of the bow prod, a releasable catch for holding the string at a cocked position spaced rearwardly from the bow prod when the bow is cocked, a trigger means depending from the fore end portion and operatively associated with said catch for effecting release of the string therefrom, cocking means for engaging the string and drawing the string from a rest position to said cocked position, and a hand grip which comprises two elongated parts, a first of which parts is rigid with the fore end portion, extends from a rear end thereof in a downward direction when the bow is in the normal position for use with the guide surface horizontal, has a rear face and has a front face which faces toward the trigger means, and a second of which parts is a forward part of the butt and has a front face, and further including first pivot means for connecting the cocking means to an upper end of said second part and second pivot means adjacent to lower ends of said parts for connecting said parts for relative pivoting movement about a pivot axis perpendicular to the respective lengths of said parts, whereby the butt can be used as a lever by pivoting the second part away from the first part to draw the string to the cocking position, pivoting of the second part toward the first part being limited by engagement of said front face of the second part with the rear face of the first part, and the respective lengths of the first and second parts being parallel to each other when said front face of the second part is engaged with said rear face of the first part.

2. A cross bow according to claim 1, further including guide means on the fore end portion for guiding the cocking means along a path which extends generally along the fore end portion and wherein an arc along which the first pivot means moves during pivoting of said second part relative to said first part has a chord which is at least approximately parallel to the guide surface and has a length at least approximately equal to the length of the path defined by the guide means.

* * * * *

UNITED STATES PATENT AND TRADEMARK OFFICE

CERTIFICATE OF CORRECTION

PATENT NO. : 4,258,689
DATED : March 31, 1981
INVENTOR(S) : Bernard Thomas Barnett It is certified that error appears in the above-identified patent and that said Letters Patent are hereby corrected as shown below:

On the title page add:

[30] Foreign Application Priority Data

Dec. 7, 1976 [GB] United Kingdom ..... 50915/76
Dec. 7, 1976 [GB] United Kingdom ..... 50917/76

Signed and Sealed this

First Day of May 1984

[SEAL]

*Attest:*

GERALD J. MOSSINGHOFF

*Attesting Officer*

*Commissioner of Patents and Trademarks*